United States Patent [19]

Yamada et al.

[11] Patent Number: 4,972,674

[45] Date of Patent: Nov. 27, 1990

[54] HEAT INSULATING CERAMIC INSERT-CAST ARTICLES FOR USE IN EXHAUST CHANNELS IN INTERNAL COMBUSTION ENGINES AND A PROCESS FOR PRODUCING THE SAME

[75] Inventors: Shunichi Yamada, Nagoya; Toshiyuki Hamanaka, Suzuka; Takashi Harada, Nagoya, all of Japan

[73] Assignee: NGK Insulators, Ltd., Japan

[21] Appl. No.: 341,710

[22] Filed: Apr. 21, 1989

[30] Foreign Application Priority Data

May 2, 1988 [JP] Japan ..... 63-109754

[51] Int. Cl.[5] ..... F01N 7/10; F01N 7/16

[52] U.S. Cl. ..... 60/323; 60/272; 60/282

[58] Field of Search ..... 60/272, 282, 323

[56] References Cited

U.S. PATENT DOCUMENTS

| | | | |
|---|---|---|---|
| 3,750,403 | 8/1973 | Deutschmann | 60/272 |
| 3,892,907 | 7/1975 | Niimi | 60/282 |
| 3,919,755 | 11/1975 | Daneko | 60/282 |
| 4,604,779 | 8/1986 | Narita | 60/272 |

FOREIGN PATENT DOCUMENTS

| | | |
|---|---|---|
| 212469 | 8/1986 | European Pat. Off. . |
| 2602434 | 7/1977 | Fed. Rep. of Germany . |
| 2408557 | 6/1979 | France . |
| 55-155507 | 4/1954 | Japan . |
| 51-16168 | 5/1976 | Japan . |

*Primary Examiner*—Douglas Hart

*Attorney, Agent, or Firm*—Arnold, White & Durkee

[57] ABSTRACT

A heat insulating ceramic insert-cast article for an internal combustion engine, comprising a ceramic liner and a metallic member enclosing an outer periphery of the ceramic liner. The ceramic liner is adapted to contact exhaust gases. A joint boundary between the ceramic liner and the metallic member is constituted by contact faces at which the ceramic liner contacts the metallic member and heat insulating air layers at which the ceramic liner and the metallic member do not contact each other. A process for producing such a heat insulating ceramic insert-cast article is also disclosed. First, the outer periphery of the ceramic liner is covered with the heat insulating layer which is partially formed with cuts, and then the ceramic liner is enclosed with a molten metal in the state that the ceramic liner is covered with the layer. Thus, the metal flows into the cuts and solidifies therein to form contact faces between the ceramic liner and the metal, while portions at which the metal does not flow inside due to the pressure of the layer are converted to heat insulating layers.

3 Claims, 3 Drawing Sheets

HEAT INSULATING CERAMIC INSERT-CAST ARTICLES FOR USE IN EXHAUST CHANNELS IN INTERNAL COMBUSTION ENGINES AND A PROCESS FOR PRODUCING THE SAME

BACKGROUND OF THE INVENTION (1) Field of the Invention

The present invention relates to heat insulating ceramic insert-cast articles for use in exhaust channels in internal combustion engines and a process for producing the same.

(2) Related Art Statement

In the case of a system for purifying exhaust gases from internal combustion engines such as gasoline engines and diesel engines and for preventing air pollution with such exhaust gases, it is desired that the temperature of the exhaust gases is maintained high, because reduction in the temperature of the exhaust gases lowers the purifying performance of the catalyst. For this reason, as described in Japanese patent publication No. 51-16,168, it is proposed that an exhaust port in a cylinder head or an exhaust manifold is lined with a heat insulating ceramic liner. Although such a ceramic liner is used as enclosed with a metal such as aluminum or the like, its heat insulating effect is not sufficient because the thickness of the liner is about 2 to 3 mm. As a result, the temperature of exhaust gases merely increases by about 20° C. as compared to the case where no liner is provided.

Under the circumstances, as trial is made, in which fibers made of a refractory material are wound around the outer periphery of a ceramic liner, and then the ceramic liner is enclosed so that heat insulation is enhanced by the fiber layer. However, since the fibers are gradually damaged due to thermal shocks on starting and stopping of engines or due to engine vibrations and heat, they lose the ability to hole the ceramic liner. Ultimately, there is the possibility that the ceramic liner slips out from the fibers. Furthermore, as shown in Japanese Utility Model Registratin Application Laid-open No. 54-56,010, a space is formed by arranging a metallic plate around the outer periphery of a ceramic liner so that a heat insulating property possessed by air may be utilized. However, since the structure is complicated and the production cost is great and since the ceramic liner is held at opposite ends only, there is a problem in that forces for holding the ceramic liner are likely to be lost.

SUMMARY OF THE INVENTION

It is an object of the present invention to solve the above-mentioned conventional problems, and to provide a heat insulating ceramic-insert cast article or an exhaust channel in an internal combustion engine, which article can keep the temperature of exhaust gases sufficiently higher than in conventional articles, is free from reduction in forces for holding as ceramic liner, is not structurally complicated, and can inexpensively be manufactured.

Another object of the present invention is to provide a process for producing such a heat insulating ceramic insert-cast article.

The above objects of the present invention can be attained by the heat insulating ceramic insert-cast article for the internal combustion engine exhaust channel, characterized in that a boundary face between a ceramic port liner to be brought into contact with exhaust gases and a metallic member enclosing the outer periphery of the ceramic liner is constituted by portions at which the ceramic liner and the metallic member partially contact each other and heat insulating air layers.

Such a heat insulating ceramic insert-cast article may be produced by covering the outer peripheral surface of the ceramic port liner with a heat insulating layer in which cuts are partially formed, and enclosing the ceramic port liner with a metal as it is so that the metal flows and solidifies in the cuts to form contacting surfaces and that portions into which the molten metal is prevented from flowing by the heat insulating layers are formed as the heat insulating air layers.

These and other objects, features and advantages of the invention will be appreciated upon reading the following description of the invention when taken in conjunction with the attached drawings, with the understanding that some modifications, variations and changes of the same could be made by the skilled person in the art to which the invention pertains without departing from the spirit of the invention or the scope of claims appended hereto.

BRIEF DESCRIPTION OF THE DRAWINGS

For a better understanding of the invention, reference is made to the attached drawings, wherein.

DETAILED DESCRIPTION OF THE INVENTION

Figure 1:
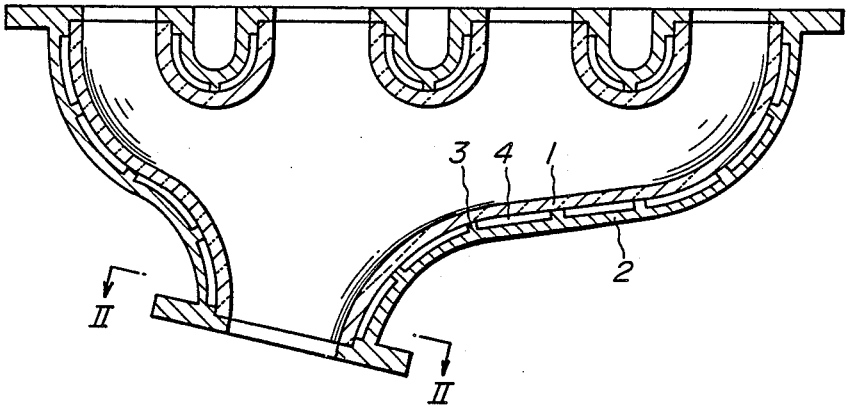
FIG. 1 is a sectional view of an exhaust manifold as a first embodiment according to the present invention.
Figure 2:
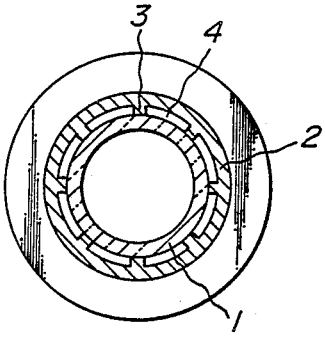
FIG. 2 is a sectional view of FIG. 1 taken along a line II—II.

The present invention will be explained in more detail with reference to the attached drawings:

In FIG. 1 is sectionally shown an exhaust manifold as an embodiment to which the present invention is applied. Reference numerals 1 and 2 are a ceramic liner for an exhaust manifold and a metallic member, respectively. The metallic member is made of an aluminum alloy, for example, and encloses the outer periphery of the ceramic liner. The ceramic liner 1 is made of a ceramic material, for instance, containing not less than 65% of aluminum titanate as a crystalline phase, and having the average particle size of not less than 10 $\mu$m, a Young's modulus of 50 to 2,000 kgf/mm$^2$, a compression strength of 5 to 40 kgf/mm$^2$, a porosity of 5 to 5 to 35%, and a heat conductivity of about 0.8 to $50\times10^3$ cal·cm·sec·°C. Thereby, the ceramic liner 1 can be prevented from being cracked during casting even in a complicated shape such as a bifurcated port liner. As shown in FIG. 1, a joint boundary between the ceramic port liner 1 and a metallic member 2 is constituted by contact faces 3 at which the ceramic liner 1 directly contacts the metallic member and heat insulating air layers 4 at which they do not contact together. As diagrammatically shown in FIGS. 4(A) through FIG. 4(D), the contact faces 3 may be designed in the liner, spiral, or dotted fashion. It is preferable that the contact faces 3 are uniformly distsributed over the entire joining boundary face between the ceramic liner 1 and the metallic member 2. However, this is not necessarily restrictive, and slight deviation therefrom is acceptable. The contact faces 3 serve to hold the ceramic liner, and it is preferable to decrease the contact faces 3 and to increase the area of the heat insulating air layers 4 so that the heat insulation may be improved. Practically, the total area of the contact faces is not more than 35% of the entire area of the boundary face, and preferably not more than 10%. The thickness of the heat insulating air layer is preferably 0.5 to 5 mm. The interior of the heat insulating air layer is void, or may be filled with fibers or the like.

Figure 3:
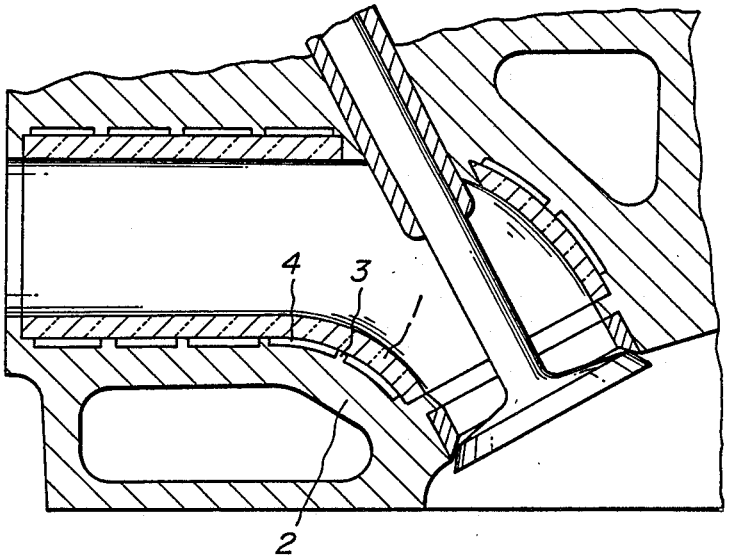
FIG. 3 is a sectional view of a cylinder head exhaust port liner as a second embodiment according to the present invention.
Figure 4A:
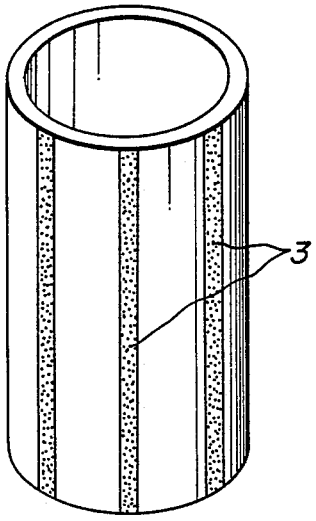
FIG. 4(A) through FIG. 4(D) are perspective views diagrammatically illustrating joining boundaries between ceramic liners and metallic members.
Figure 4B:
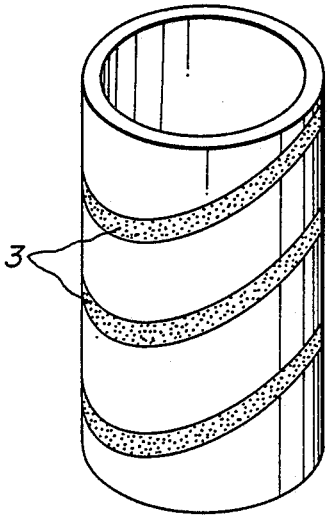
Figure 4C:
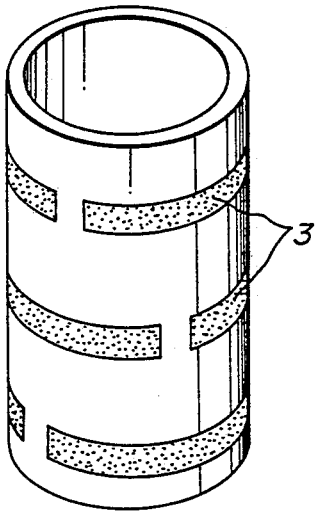
Figure 4D:
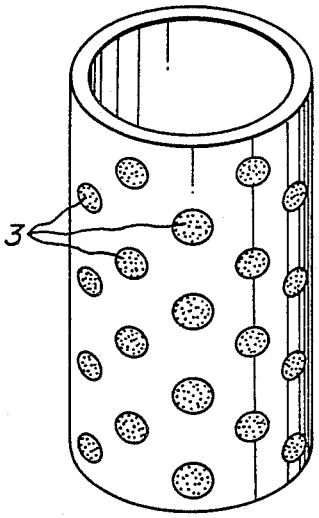

FIG. 3 shows an embodiment in which the present invention is applied to a port liner. The structure of a joining boundary is the same as the above exhaust manifold.

Since the ceramic liner 1 itself not only has heat insulating property and but also the heat insulating air layers 4 exhibit excellent heat insulating effect, the temperature of exhaust gases can be maintained high by such a heat insulating ceramic insert-cast article according to the present invention. Furthermore, since the outer periphery of the ceramic liner 1 is directly supported by the contact faces 3 partially formed at the joint boundary with accuracy according to the present invention, it is not feared that the forces for holding the ceramic liner 1 are lowered.

Next, the process for producing heat insulating ceramic insert-cast articles according to the present invention will be explained.

First, the outer periphery of the ceramic liner 1 is covered with a layer which can withstand a molten metal during enclosing. It is preferable to use a water-soluble glass powder or a water-soluble glass fiber sheet which can be removed after the enclosing, or a cast sand solidified by a cold box process. The glass fiber sheet is made of glass containing not less than 30% by weight or boron oxide, and preferably not less than 50% by weight. This glass fiber sheet can sufficiently withstand the temperature at which the ceramic liner is enclosed with aluminum, which is terminated in a short time, and can readily be dissolved with hot water containing an alkaline compound such as NaOH. On the other hand, the cold box process is a process in which an isocyanate resin is added to cast sand as a binder, and is cured with an amine gas after shaping. After the heat treatment at around 500° C., the resin can easily be broken by light vibrations. Such a layer is partially formed with cuts. When the ceramic liner 1 is enclosed with the molten metal in the state that the liner is covered with this layer, the molten metal flows into the cuts formed in the layer, and solidifies there to form contact faces between the ceramic liner 1 and the metallic member 2. On the other hand, portions at which the molten metal is prevented with the layer from flowing inside are converted to the heat insulating air layers as voids by removing the layer with hot water or by heat treatment. As the material of the layer, besides the above materials, a general fiber sheet may be used. In this case, the sheet may mechanically be scraped out after the solidification. When the porosity of the layer itself is large, the layer may be retained as a heat insulating layer 4 without being removed. The heat insulating ceramic insert-cast article according to the present invention may easily and inexpensively be produced by the above process.

In order to confirm the effect of the articles according to the present invention, the following experiment was conducted.

A cylinder having an outer diameter of 30 mm, a thickness of 4 mm, and a length of 300 mm was prepared from a ceramic material containing aluminum titanate as main crystals and having a Young's modulus of 200 kgf/mm$^2$. Next, a water-soluble glass fiber sheet was fitted around the outer periphery of the cylinder, which was enclosed with aluminum. The sheet was formed with a number of 3 mm diameter holes to give an area ratio of the contact faces of 10% or 20%. As a result, an insert-cast product having an outer diameter of 45 mm and a length of 300 mm was obtained. After cooling, the water-soluble glass fiber sheet was removed by washing with water.

Exhaust gases from an engine at 700° C. were led to each of the thus obtained test pieces, and a heat insulating effect thereof was evaluated. As compared with an exhaust pipe made of a stainless steel with no ceramic cylinder, the temperature of the exhaust gases could be maintained higher by 70° C. and 60° C. in the case of the aluminum insert-cast test pieces having the area ratio of the contact faces 3 being 10% and 20%, respectively. Furthermore, in the case of a test piece in which a ceramic fiber sheet having a larger porosity and holes formed therein to give an area ratio of the contact faces 3 being 20% was used and not removed after insert-casting, the temperature of the exhuast gases could be maintained higher by about 40° C. The temperature of the exhaust gases could be maintained higher by about 20° C. in the case of a ceramic liner directly enclosed with aluminum in which the area ratio of the contact face 3 was 100%.

As is clear from the foregoing explanation, the present invention has various merits. This is, the heat insulating effect is excellent, and the temperature of exhaust gases can be maintained sufficiently higher as compared with conventional articles. Further, it is not feared that the force for holding the ceramic liner will decrease lower, the structure is simple, and production can inexpensively be done. Thus, the ceramic insert-cast article according to the present invention is preferable for the cylinder head exhaust port or the exhaust manifold. Thus, the present invention solves the conventional problems and provides the heat insulating ceramic insert-cast article and the process for producing the same. Consequently, the invention greatly contributes to the developments in the industries.

What is claimed is:

1. A heat insulating ceramic insert-cast article for use in an exhaust channel in an internal combustion engine, comprising:

a ceramic liner and a metallic member which substantially completely encloses an outer periphery of said ceramic liner, said ceramic liner comprising an aluminum titanate-based ceramic material having a Young's modulus of not more than 2,000 kgf/mm$^2$;

wherein a joint boundary between said ceramic liner and said metallic member is formed by contact faces, at which said ceramic liner contacts said metallic member, and heat insulating air layers, at which said ceramic liner and said metallic member do not contact each other.

2. The insert-cast article of claim 1, wherein a cross-sectional area of said contact faces is 30% of an entire cross-sectional area of said joint boundary.

3. The insert-cast article of claim 1, wherein the insert-cast article is used for an exhaust manifold.

* * * * *